US006312230B1

(12) United States Patent
Popov

(10) Patent No.: US 6,312,230 B1
(45) Date of Patent: Nov. 6, 2001

(54) LIQUID-GAS JET APPARATUS VARIANTS

(75) Inventor: Serguei A. Popov, 4615 Post Oak Pl. Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/445,998

(22) PCT Filed: Apr. 16, 1999

(86) PCT No.: PCT/IB99/00676

§ 371 Date: Dec. 17, 1999

§ 102(e) Date: Dec. 17, 1999

(87) PCT Pub. No.: WO99/54629

PCT Pub. Date: Oct. 28, 1999

(30) Foreign Application Priority Data

Apr. 17, 1998 (RU) ..... 98107183

(51) Int. Cl.[7] ..... F04F 5/44
(52) U.S. Cl. ..... 417/196; 417/198
(58) Field of Search ..... 417/196, 198, 417/176, 151

(56) References Cited

U.S. PATENT DOCUMENTS

| | | | | |
|---|---|---|---|---|
| 2,582,069 | | 1/1952 | Rose . | |
| 3,625,820 | * | 12/1971 | Gluntz et al. | 417/196 |
| 4,842,777 | * | 6/1989 | Lamort | 417/196 |
| 5,087,175 | * | 2/1992 | Raizman et al. | 417/196 |
| 5,628,623 | | 5/1997 | Skaggs . | |

FOREIGN PATENT DOCUMENTS

| | | |
|---|---|---|
| 2016262 | 7/1994 | (RU) . |
| 985462 | 12/1982 | (SU) . |
| 1483106 | 5/1989 | (SU) . |

OTHER PUBLICATIONS

Sokolov E.Y., Zinger N.M., "Jet apparatuses" book, 1989, USSR, Moscow, "Energoatomizdat" Publishing house, pp. 213, 254.

* cited by examiner

*Primary Examiner*—Cheryl J. Tyler
(74) *Attorney, Agent, or Firm*—Mark A. Oathout

(57) ABSTRACT

The mixing chamber of a liquid jet apparatus is composed of a convergent inlet section and a cylindrical outlet section and the ratio between of the surface area of the minimal cross-section of the mixing chamber and the surface area of the inlet cross-section of the mixing chamber ranges from 0.005 to 0.392, and the angle of inclination between either the ruling line of a conical surface forming the convergent inlet section of the mixing chamber or the tangents to each point of a curved surface forming the convergent inlet section and the flow axis of the mixing chamber ranges from 30' to 10°. In another embodiment of the jet apparatus, the whole mixing chamber converges in the flow direction and the ratio of the surface area of the minimal cross-section of the mixing chamber to the surface area of the inlet cross-section of the mixing chamber ranges from 0.005 to 0.392, and the angle of inclination between either the ruling line of a conical surface forming the convergent mixing chamber or the tangents to each point of a curved surface forming the convergent mixing chamber and the flow axis of the mixing chamber ranges from 30' to 10°. A jet apparatus realized according to the above-mentioned dimensions exhibits an improved efficiency.

8 Claims, 1 Drawing Sheet

LIQUID-GAS JET APPARATUS VARIANTS

BACKGROUND OF THE INVENTION

The present invention pertains to the field of jet technology, primarily to liquid-gas jet apparatuses for evacuation of gaseous mediums.

A liquid-gas jet apparatus is known, which has a nozzle, a receiving chamber and a cylindrical mixing chamber (see, Sokolov E. Y. & Zinger N. M., "Jet apparatuses" book, Moscow, "Energoatomizdat" Publishing house, 1989, page 213).

Such liquid-gas jet apparatuses allow evacuation of various gaseous mediums. However, the efficiency factor of these jet apparatuses is low, therefore the range of their application is limited.

The closest analogue of the jet apparatus described in the present invention is a liquid-gas jet apparatus, comprising a nozzle and a mixing chamber composed of an inlet convergent section and an outlet cylindrical section (see, Sokolov E. Y. & Zinger N. M., "Jet Apparatuses" book, Moscow, "Energoatomizdat" Publishing house, 1989, page 254).

The given jet apparatuses are widely used as air-ejecting devices of steam turbine units. One of the main advantages of the employment of liquid-gas apparatuses in condensers of modem modular steam turbines is the possibility starting the turbine unit without feeding steam from an outside source. But these apparatuses also have a relatively low efficiency factor.

SUMMARY OF THE INVENTION

The objective of the present invention is to increase the efficiency factor of the liquid-gas jet apparatus.

The objective is attained as follows: a liquid-gas jet apparatus, having a nozzle and a mixing chamber composed of a convergent inlet section and a cylindrical outlet section, has a ratio of the surface area of the minimal cross-section of the mixing chamber to the surface area of the inlet cross-section of the mixing chamber that ranges from 0.005 to 0.392. At the same time, the ruling line of a conical surface forming the convergent section of the mixing chamber or the tangents to each point of a curved surface forming the convergent section of the mixing chamber are inclined to the axis of said chamber at an angle of between 30' and 10°.

The convergent section of the mixing chamber can be formed by a conical surface or it can be formed by a curved surface smoothly turning into a surface of the cylindrical outlet section of the mixing chamber. The jet apparatus can also be furnished with a guide confessor mouth installed at the entrance of the inlet section of the mixing chamber and with a diffuser installed at the outlet of the cylindrical section of the mixing chamber.

There is another variant embodiment of the apparatus wherein the liquid-gas jet apparatus comprises a nozzle and a mixing chamber converging in the flow direction. In this apparatus, the ratio of the surface area of the minimal cross-section of the convergent mixing chamber to the surface area of the inlet cross-section of this mixing chamber ranges from 0.005 to 0.392 and the inclination of the ruling line of a conical surface of the convergent mixing chamber or the angle is of inclination of the tangents to each point of a curved surface of the mixing chamber to the axis of the mixing chamber is from 30' to 10°.

The convergent mixing chamber can be formed by a conical surface or by a curved surface. An outlet section of the mixing chamber formed by a curved surface can smoothly turn into a cylindrical surface.

Experimental research has shown, that the correlation of the dimensions of the mixing chamber exerts a significant influence on the performance of the liquid-gas jet apparatus. One series of experiments were carried out with the liquid-gas jet apparatuses whose mixing chambers have convergent inlet sections formed by a curved surface or by a conical surface. In addition to the convergent inlet sections the mixing chambers of the apparatuses tested under this first experimental program were always tested with the embodiment having cylindrical outlet sections. Another series of tests were carried out with the liquid-gas jet apparatuses having entirely convergent mixing chambers, i.e. mixing chambers without the cylindrical outlet section. Some of these apparatuses were furnished with a diffuser. In the latter case, the entirely convergent mixing chamber turned or transitioned directly into the diffuser in the zone of the minimal cross-section of the mixing chamber.

It was determined that, regardless of the embodiment of the liquid-gas jet apparatus, the correlation of the dimensions of the convergent inlet section of the mixing chamber (or the correlation of the dimensions of the entirely convergent mixing chamber) has a vital importance for the proper formation of a gas-liquid mixture in the mixing chamber, where generation of the mixed gas-liquid flow starts and comes to the end.

During the research it was also determined that energy losses during the mixing of an evacuated gaseous medium and an ejecting liquid medium are minimal when the ratio of the surface area of the minimal cross-section of the mixing chamber (in case the mixing chamber has a cylindrical outlet section the minimal cross-section of the mixing chamber is a cross-section of its cylindrical outlet section) to the surface area of the inlet cross-section of the mixing chamber ranges from 0.005 to 0.392 and when the angle of inclination of the ruling line of a conical surface forming the convergent section of the mixing chamber to the axis of the mixing chamber or the angle of inclination of the tangents to each point of a curved surface forming the convergent section of the mixing chamber to the axis of the mixing chamber is from 30' to 10°.

It turned out that when the mixing chamber of the liquid-gas jet apparatus does not have the cylindrical outlet section, i.e. when the mixing chamber as a whole converges in the flow direction, the optimal correlation between the mixing chamber dimensions remains the same. In other words, the ratio of the surface area of the minimal cross-section of the mixing chamber to the surface area of the inlet cross-section of the mixing chamber must be from 0.005 to 0.392 and the angle of inclination of the ruling line of a conical surface forming the convergent mixing chamber to the axis of the mixing chamber or the angle of inclination of the tangents to each point of a curved surface forming the convergent mixing chamber to the axis of the mixing chamber must be from 30' to 10°.

Nevertheless, an embodiment of the entirely convergent mixing chamber is also possible, wherein the end of the curve forming the mixing chamber surface smoothly turns or transitions into a cylindrical surface. This is expedient if some processes occur in the gas-liquid flow inside the mixing chamber in addition to the mixing process. Such processes are, for example, partial condensation of a gaseous component of the gas-liquid mixture in a motive liquid, being accompanied by conversion of the gas-liquid flow into a supersonic flow regime with subsequent deceleration of the flow in a pressure jump (the exact location of the jump can not be determined in the given case).

Thus, based on the assumption of the above mentioned correlation of dimensions and geometry, the described mixing chambers having a convergent inlet section and a cylindrical outlet section or the entirely convergent mixing chambers provide a resolution of the objective stated in the invention, i.e. liquid-gas jet apparatuses realized in accordance with the introduced conditions have an increased efficiency factor. It is necessary to note that the discovered optimal correlations of the dimensions are applicable for both single-nozzle and multi-nozzle liquid-gas jet apparatuses.

DETAILED DESCRIPTION OF THE INVENTION

Figure 1:
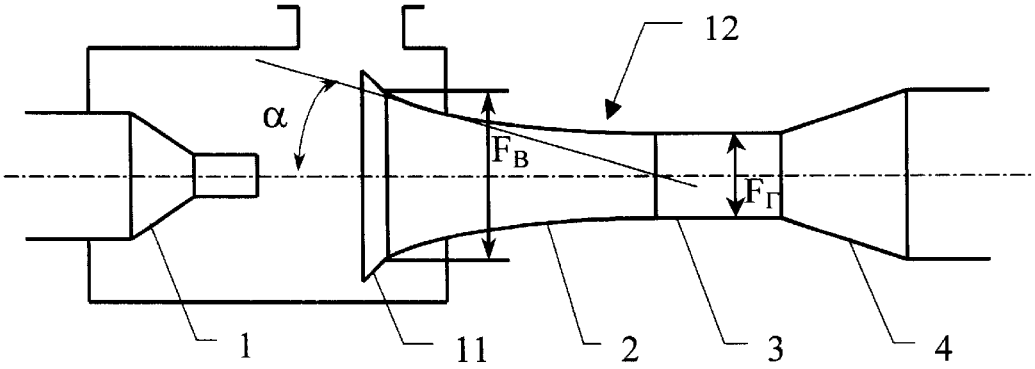
FIG. 1 represents a schematic diagram of a single-nozzle liquid-gas jet apparatus with a curved convergent inlet section of a mixing chamber.

The liquid-gas jet apparatus shown in FIG. 1 comprises a nozzle 1 and a mixing chamber 12 composed of a convergent inlet section 2 and a cylindrical outlet section 3. The jet apparatus can also be furnished with a diffuser 4 installed at the end of the cylindrical outlet section 3 of the mixing chamber 12. In a multi-nozzle variant (FIG. 2) the jet apparatus comprises nozzles 5 and mixing chambers 13 composed of convergent inlet sections 6 and cylindrical outlet sections 7. Diffusers 9 exiting into a discharge chamber 8 can be installed behind the mixing chambers 13. The mixing chamber 12 or mixing chambers 13 have a ratio between the surface area (at diameter $F_\Gamma$) of the minimal cross-section (or cross-sections) to the surface area (at diameter $F_\Gamma$) of the inlet cross-section (or cross-sections) that ranges from 0.005 to 0.392 and an angle of inclination $\alpha$ between the ruling line of a conical surface forming the convergent inlet section 6 and the flow axis of the mixing chamber 13 or angle of inclination $\alpha$ between the tangents to each point of a curved surface forming the convergent inlet section 2 and the flow axis of the mixing chamber 12 which ranges from 30' to 10°.

Figure 3:
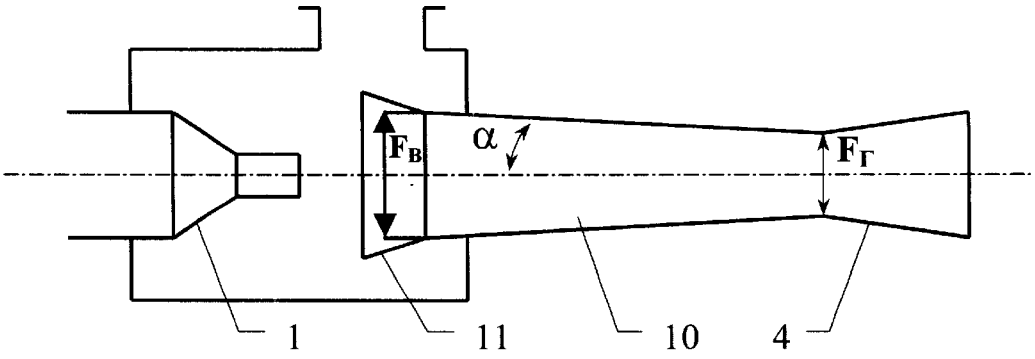
FIG. 3 represents a schematic diagram of a liquid-gas jet apparatus with a mixing chamber, which is entirely convergent in the flow direction.

There is another embodiment of the jet apparatus (FIG. 3), where the liquid-gas jet apparatus has a nozzle 1, a mixing chamber 10 converging in the flow direction and a diffuser 4 (if any) at the outlet of the mixing chamber 10. A ratio between the surface area (at diameter $F_\Gamma$) of the minimal cross-section of the convergent mixing chamber 10 and the surface area (at diameter $F_B$) of the inlet cross-section of the convergent mixing chamber 10 ranges from 0.005 to 0.392 and the angle of inclination $\alpha$ between the ruling line of a conical surface forming the convergent mixing chamber 10 and the flow axis of the mixing chamber 10 or the angle of inclination $\alpha$ between the tangents to each point of a curved surface forming the convergent mixing chamber 10 (a mixing chamber with a curved surface has not been presented in the drawings) and the flow axis of the mixing chamber 10 is from 30' to 10°.

The inlet convergent section 2 of the mixing chamber 12 can be formed by a curve and it can smoothly or evenly turn or transition into the cylindrical outlet section 3 of the mixing chamber 12. The jet apparatus can be furnished with a guide confusor mouth 11 installed at the entrance of the convergent inlet section 2 or the convergent inlet section 6 of the mixing chamber 13. The guide mouth 11 can also be installed at the entrance of the convergent mixing chamber 10. If the convergent mixing chamber 10 is formed by a curved surface, the end of the curved surface can smoothly turn or transition into a cylindrical surface.

The liquid-gas jet apparatus operates as follows.

Figure 2:
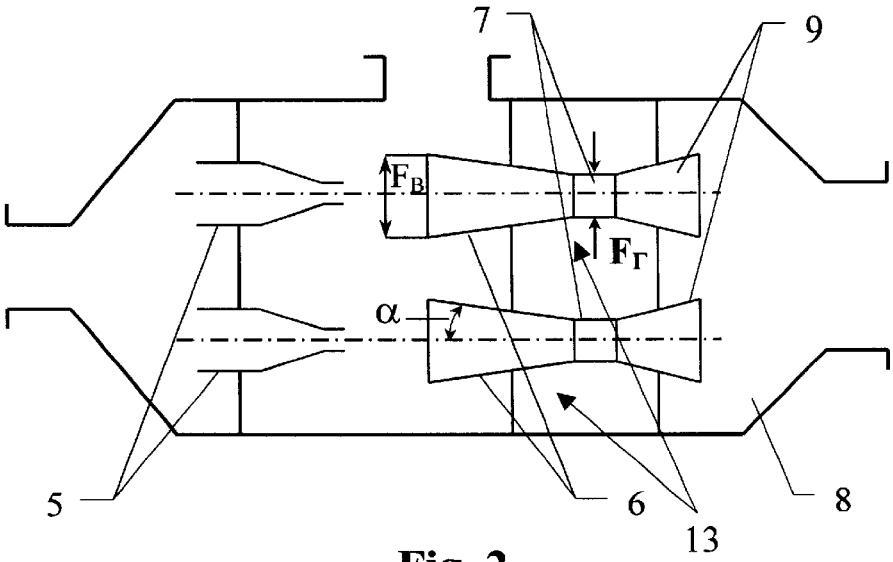
FIG. 2 represents a schematic diagram of a multi-nozzle liquid-gas jet apparatus with conical convergent inlet sections of the mixing chambers.

A motive liquid medium is fed under pressure into the nozzle 1 or nozzles 5. The motive liquid is discharged through the nozzle 1 or nozzles 5 and entrains a gaseous medium into the mixing chamber 12 or 13 composed of the convergent inlet section 2 and the cylindrical outlet section 3 or into the convergent mixing chamber 10, subject to the variant of design of the jet apparatus. In a multi-nozzle embodiment of the jet apparatus the gaseous medium flows simultaneously into several mixing chambers 13. These mixing chambers can be entirely convergent as the mixing chamber 10 in FIG. 3 or they can have the convergent inlet sections 6 and cylindrical outlet sections 7 as shown in FIG. 2. Regardless of the design, in the mixing chambers the motive liquid is mixed with the gaseous medium. Simultaneously the motive liquid compresses the gas due to the partial transformation of its kinetic energy. Then, subject to the apparatus design, a gas-liquid mixture is discharged from the apparatus or the mixture passes into the diffuser 4 or diffusers 9 (if they are installed). In the diffuser 4 or diffusers 9 kinetic energy of the gas-liquid flow is converted partly into potential energy of pressure and the gaseous components of the flow are additionally compressed. Then, the gas-liquid mixture is delivered from the jet apparatus to its destination depending on the particular application of the apparatus.

Industrial Applicability

The described liquid-gas jet apparatus can be applied in chemical, petrochemical, agriculture and any other industries, where evacuation and compression of gaseous mediums are required.

What is claimed is:

1. A liquid-gas jet apparatus, comprising:

a nozzle; and a mixing chamber having a convergent inlet section and a cylindrical outlet section;

wherein the ratio of the surface area of the minimal cross-section of the mixing chamber to the surface area of the inlet cross-section of the mixing chamber ranges from 0.005 to 0.392; and wherein the angle of inclination ranges from 30' to 10° for at least one angle between the ruling line of a conical surface of the mixing chamber's convergent inlet section and the mixing chamber's flow axis, and the tangents to each point of a curved surface of the mixing chamber's convergent inlet section and the mixing chambers flow axis.

2. The liquid-gas jet apparatus according to claim 1, wherein the convergent inlet section of the mixing chamber is formed by a conical surface.

3. The liquid-gas jet apparatus according to claim 1, wherein the convergent inlet section of the mixing chamber is formed by a curved surface having a means for turning evenly into a surface of the cylindrical outlet section of the mixing chamber.

4. The liquid-gas jet apparatus according to claims 1, further comprising a guide confusor mouth installed at the entrance of the convergent inlet section of the mixing chamber.

5. The liquid-gas jet apparatus according to claim 1, further comprising a diffuser installed at the exit from the cylindrical outlet section of the mixing chamber.

6. A liquid-gas jet apparatus, comprising:

a nozzle; and a mixing chamber converging in the flow direction;

wherein the ratio of the surface area of the minimal cross-section of the convergent mixing chamber to the surface area of the inlet cross-section of the convergent mixing chamber ranges from 0.005 to 0.392; and wherein the angle of inclination ranges from 30' to 10° for at least one angle between the ruling line of a conical surface of the convergent mixing chamber and the convergent mixing chamber's flow axis, and the tangents to each point of a curved surface of the convergent mixing chamber and the convergent mixing chamber's flow axis.

7. The liquid-gas jet apparatus according to claim 6, wherein the convergent mixing chamber is formed by a conical surface.

8. The liquid-gas jet apparatus according to claim 6, wherein the convergent mixing chamber is formed by a curved surface having a means for turning evenly into a cylindrical surface.

* * * * *